US006186646B1

(12) United States Patent
Wiedemer, Jr.

(10) Patent No.: US 6,186,646 B1
(45) **Date of Patent: *Feb. 13, 2001**

(54) LIGHTING FIXTURE HAVING THREE SOCKETS ELECTRICALLY CONNECTED AND MOUNTED TO BOWL AND COVER PLATE

(75) Inventor: Richard A. Wiedemer, Jr., Cleveland, OH (US)

(73) Assignee: Hinkley Lighting Incorporated, Cleveland, OH (US)

( * ) Notice: Under 35 U.S.C. 154(b), the term of this patent shall be extended for 0 days.

This patent is subject to a terminal disclaimer.

(21) Appl. No.: 09/275,573

(22) Filed: Mar. 24, 1999

(51) Int. Cl.[7] ..... F21V 21/00
(52) U.S. Cl. ..... 362/249; 362/227; 439/615
(58) Field of Search ..... 362/249, 226, 362/227, 810, 457; 439/615

(56) References Cited

U.S. PATENT DOCUMENTS 1,552,121 * 9/1925 Dau ..... 362/249
1,560,885 * 11/1925 Van Horne ..... 362/249
3,435,286 * 3/1969 Kayatt ..... 315/47
4,428,032 * 1/1984 Workman ..... 362/96
4,835,748 * 5/1989 Krause, Jr. ..... 362/249
5,124,903 * 6/1992 Coviello ..... 362/392
5,506,760 * 4/1996 Giebler et al. ..... 362/249
6,022,125 * 2/2000 Bartasevich et al. ..... 362/251
6,062,816 * 5/2000 Chang ..... 416/5
6,116,754 * 9/2000 Ocsovai et al. ..... 362/260

* cited by examiner

*Primary Examiner*—Alan Cariaso
*Assistant Examiner*—Ronald E. DelGizzi
(74) *Attorney, Agent, or Firm*—Woodling, Krost and Rust

(57) ABSTRACT

A lighting fixture having three lights residing in three sockets is disclosed. The light sockets are mounted by brackets to a cover plate. The cover plate is secured to a bowl by means of an interconnecting support in combination with an upper threaded stud and a threaded cap. The interconnecting support is secured at one end thereof to the bowl by means of a lower threaded stud and a nut. A flange socket is secured to the bowl by screws. Wiring means are employed to electrically connect the socket and the light bulbs for illuminating them.

5 Claims, 6 Drawing Sheets

LIGHTING FIXTURE HAVING THREE SOCKETS ELECTRICALLY CONNECTED AND MOUNTED TO BOWL AND COVER PLATE

FIELD OF THE INVENTION

The invention is a light fixture which interengages a light socket. The light socket then provides electricity to illuminate three light bulbs which are circumferentially spaced on a cover.

BACKGROUND OF THE INVENTION

This invention relates to devices which are adaptable for receiving electric power from a typical light socket.

SUMMARY OF THE INVENTION

A lighting fixture is disclosed which includes a socket flange and a bowl. The socket flange is affixed to the bowl. A cover is affixed to the interconnecting support. There are three light bulbs which engage corresponding bulb sockets. The brackets are mounted to the cover. The bulb sockets are affixed to brackets. Wiring means supplies electric power from the socket flange to the light bulb.

The interconnecting support is U-shaped and includes a first interior threaded portion and a second interior threaded portion. A lower threaded stud engages the first interior portion and affixes the interconnecting support to the bowl by means of a nut which is threaded on to the stud. An upper threaded stud engages the second interior threaded portion and a threaded cap is used in combination therewith to affix the cover to the bowl.

It is an object of the present invention to provide a decorative lighting fixture which is adaptable to be mounted on and powered by a light socket. This invention may be used in a downwardly oriented light or it may be used in an upwardly oriented light or it may even be used in a horizontally oriented light or at any angle between horizontal and vertical. This enables the user of a typical light bulb to replace that light bulb with the decorative lighting fixture of the instant invention.

It is an object of the present invention to provide a decorative lighting fixture capable of interconnecting with a typical lighting socket wherein the decorative lighting fixture includes a conically shaped bowl. The conically shaped bowl enables use of the invention in a typical lighting socket which may have a cover around a portion of it.

It is an object of the present invention to provide a decorative lighting fixture which may be used in existing applications such as outdoor lights.

It is an object of the present invention to provide a lighting fixture having a single lamp.

It is an object of the present invention to provide a lighting fixture having a three-light candelabra cluster.

Other objects of the present invention will become apparent when considering the brief description of the drawings, the description of the invention and the claims which follow hereinbelow.

DESCRIPTION OF THE INVENTION

Figure 1:
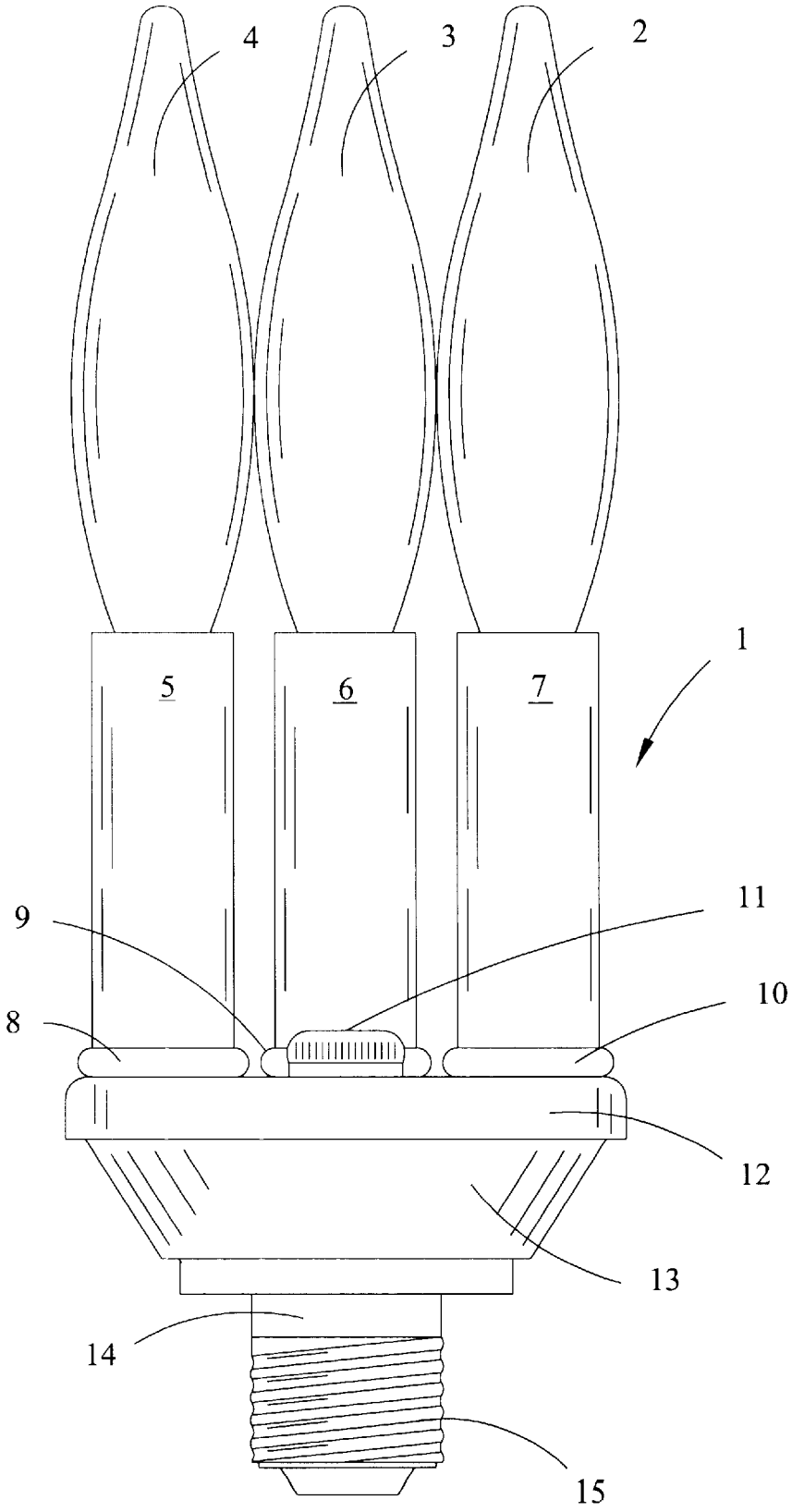
FIG. 1 is a front view of the lighting fixture.
Figure 2:
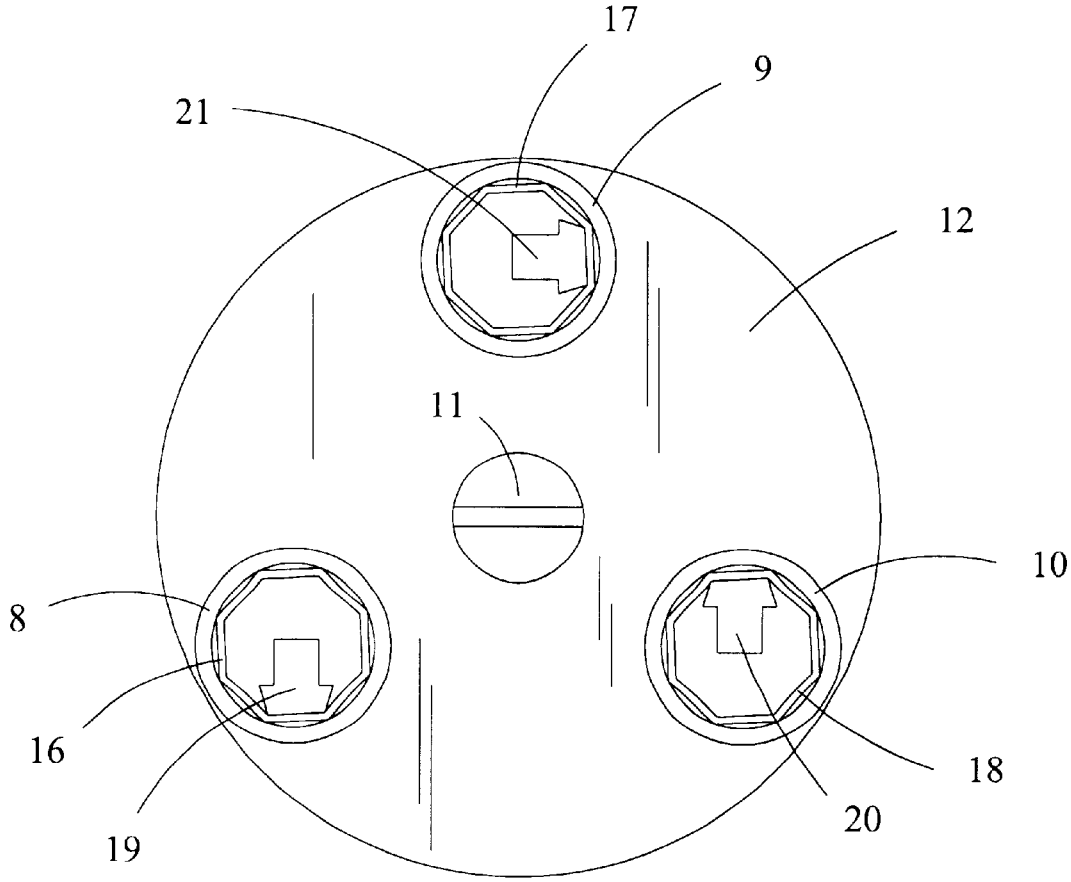
FIG. 2 is a top view of the lighting fixture without the light bulbs.
Figure 3:
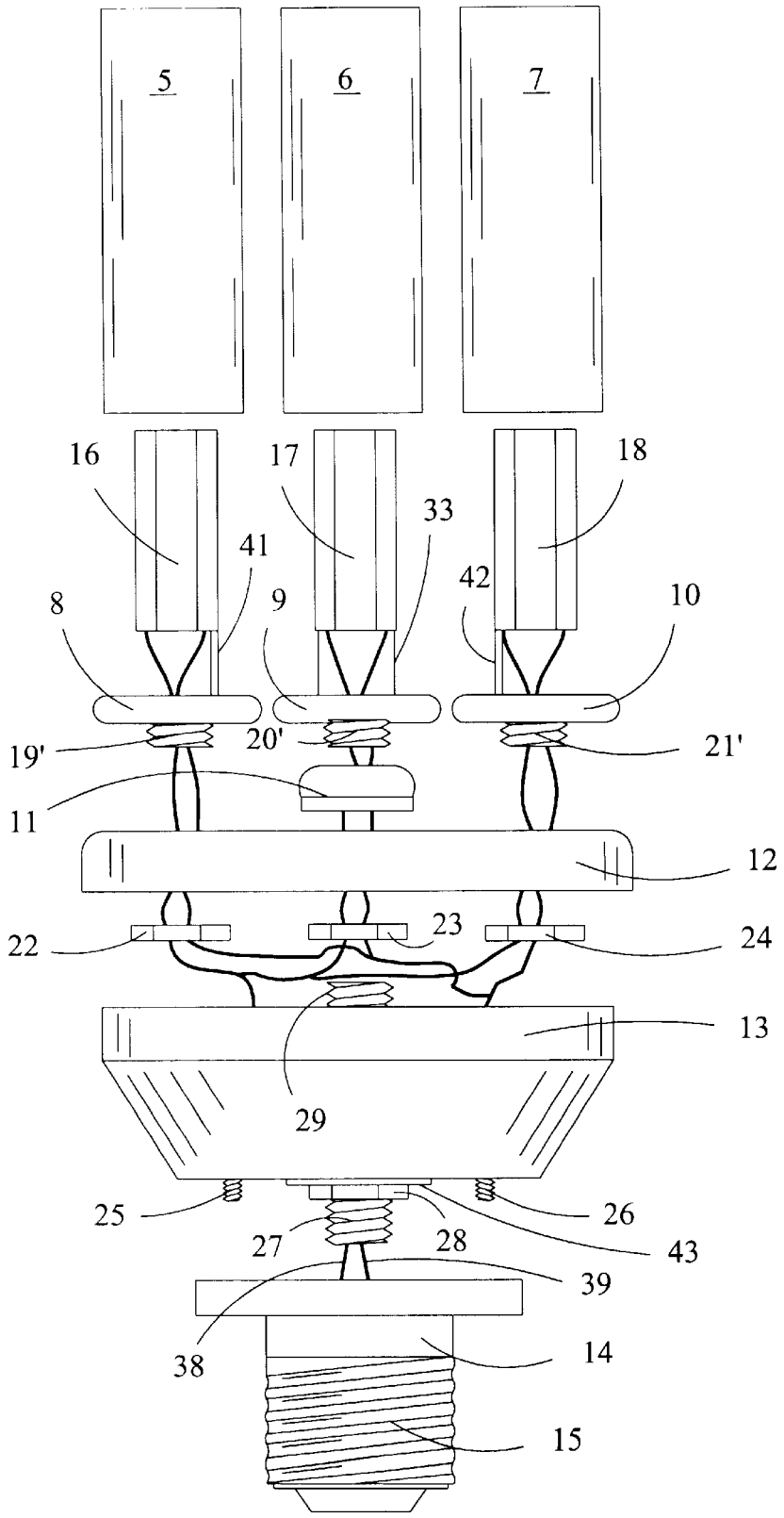
FIG. 3 is an exploded front view of the lighting fixture without the light bulbs.

FIG. 1 is a front view of the lighting fixture 1 illustrating a first light bulb 2, a second light bulb 3, and a third light bulb 4. A first shroud 5, a second shroud 6, and a third shroud 7 are also illustrated in FIG. 1. First cup 8, second cup 9, and third cup 10 are affixed to the cover and are illustrated in FIG. 1. The shrouds 5, 6 and 7 are preferably metallic shrouds and are typically painted as desired by the user. The shrouds cover corresponding light bulb sockets which are illustrated in FIGS. 2 and 3. The first light bulb socket 16, the second light bulb socket 17 and the third light bulb socket 18 are illustrated in FIGS. 2 and 3.

FIG. 1 also indicates an internally threaded cap 11, a cover 12, a bowl 13, and a socket flange 14 having a threaded portion 15 thereof for electrical contact with an electrical source.

Referring to FIG. 2, contacts 19, 20 and 21 are shown for powering the light bulbs. FIG. 2 is a top view of the lighting fixture without the light bulbs shown. The other electrical contact necessary to power the light bulb is not illustrated in FIG. 2 but resides generally around the inner circumference of the socket. It will be noted that the light bulb sockets 16, 17 and 18 are circumferentially spaced around cover 12.

Referring to FIG. 3, which is an exploded front view of the lighting fixture without the light bulbs, wiring leads 38 and 39 are illustrated emanating from the socket flange 14. Bowl 13 is affixed to socket flange 14 by means of first and second screws 25 and 26. Screws 25 and 26 mate with corresponding receptacles in socket flange 14. Cups 8, 9 and 10 are affixed to cover 12 by means of studs 19', 20' and 21' in combination with brackets 41, 33 and 42 and nuts 22, 23 and 24. The brackets are threaded to their respective studs. These brackets support the generally hexagonal light bulb sockets 17, 16 and 18, respectively.

Figure 4:
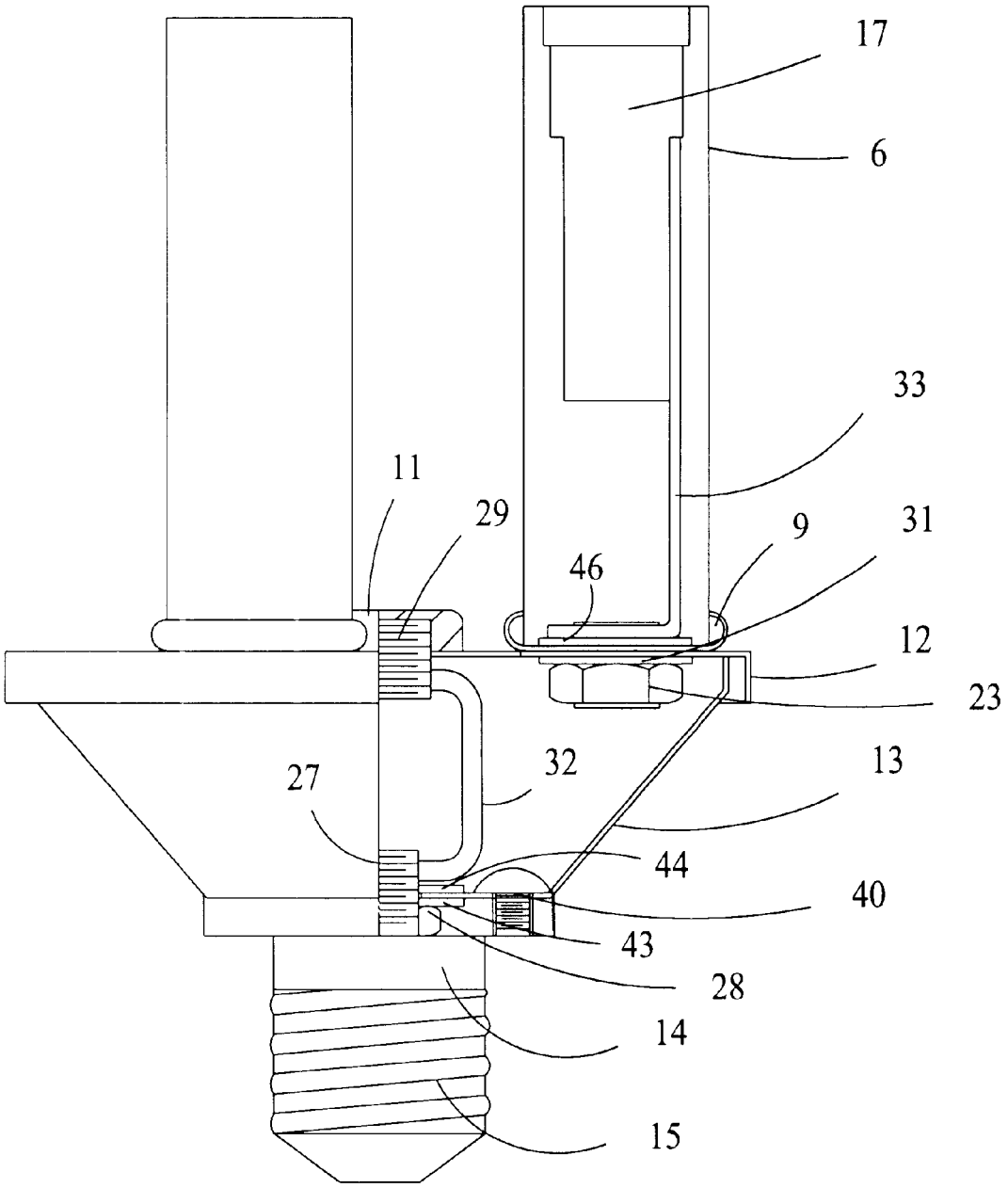
FIG. 4 is a partial cross-sectional view of the lighting fixture illustrating the interconnecting support.

FIG. 4 is a partial cross-sectional view of the lighting fixture illustrating the interconnecting support 32. Lower threaded stud 27 is threaded into the interconnecting support as is the upper threaded stud 29. Washers 43 and 44 secure the interconnecting support 32 to the cover 13 along with nut 28. Cover 12 is secured to the bowl 13 by means of threaded cap 11. Threaded cap 11 has internal threads thereon. One of the brackets 33 is illustrated in FIG. 4. Bracket 33 supports generally hexagonal second light bulb socket 17. Bracket 33 is threaded to stud 20' and nut 23 secures stud 20' to cover 12. A lock washer 31 resides between nut 23 and cover 12. A lock washer 46 resides between bracket 33 and cup 9.

Figure 5:
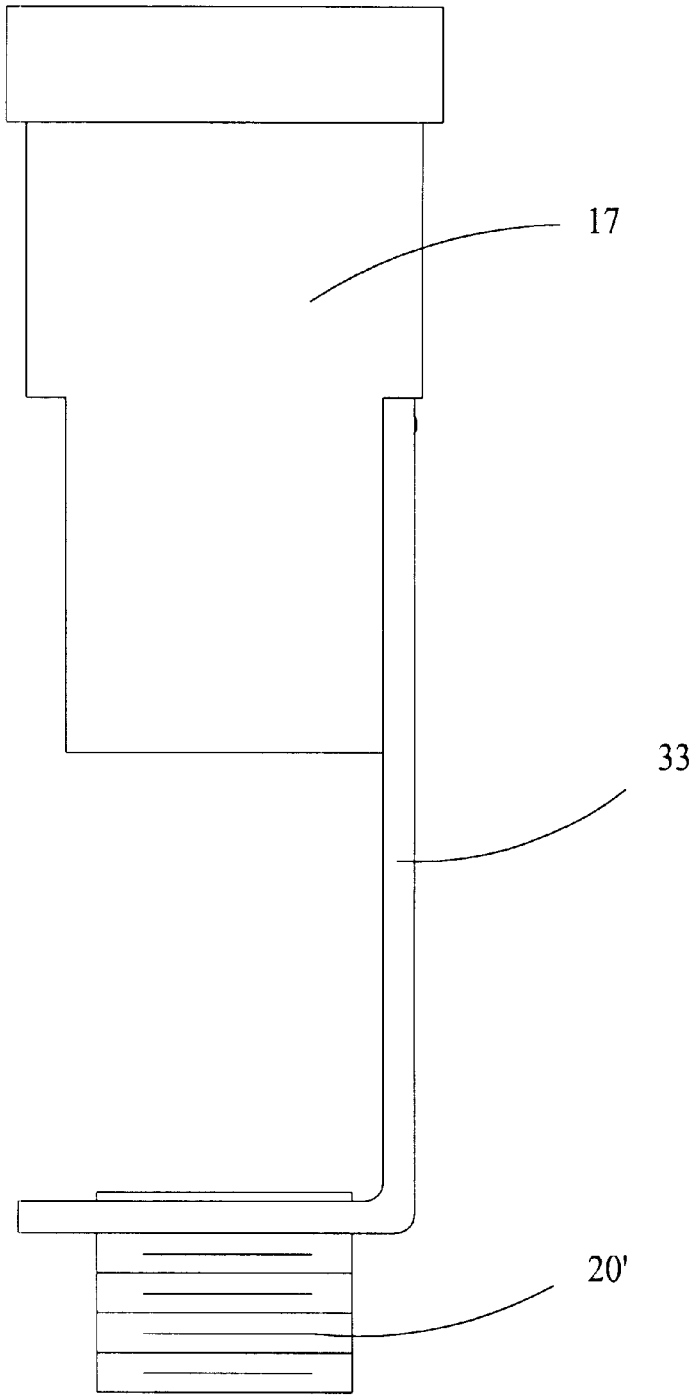
FIG. 5 is an enlarged side view of a bracket which supports a light socket. A stud which enables connection to the cover is also illustrated.

FIG. 5 is an enlarged side view of the bracket which supports a light socket.

Figure 6:
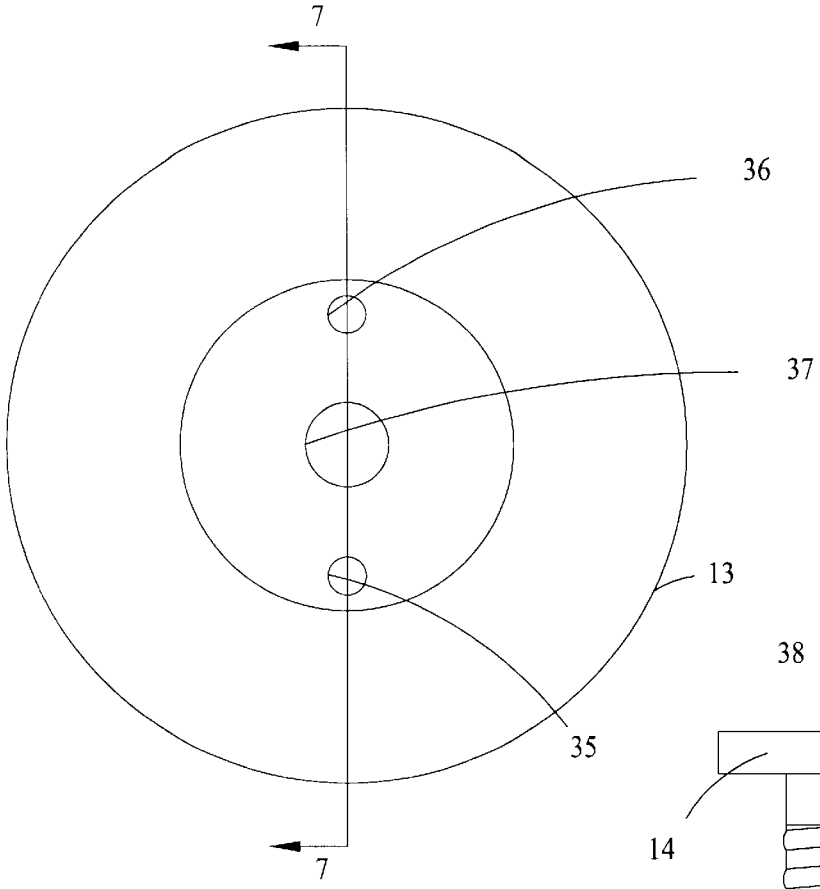
FIG. 6 is a top view of the bowl illustrating apertures which enable affixation of the bowl to the flanged socket and affixation of the interconnecting support to the bowl.

FIG. 6 is a top view of the bowl 13 illustrating apertures 35, 36 and 37 which enable affixation of the bowl 13 to the socket flange 14 and affixation of the interconnecting support 32 to the bowl 13. Lower threaded stud 27 passes through aperture 37 of bowl 13.

Figure 7:
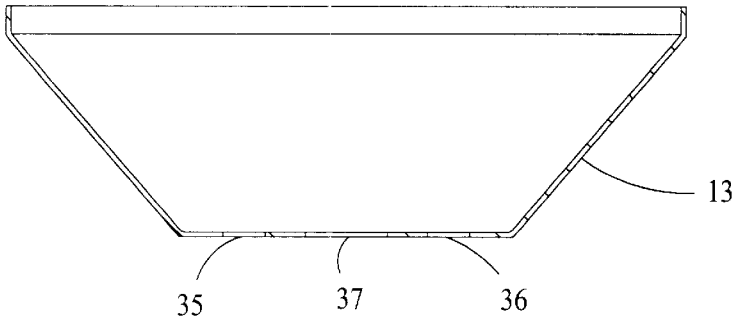
FIG. 7 is a cross-sectional view of the bowl taken along lines 7—7 of FIG. 6.

FIG. 7 is a cross-sectional view of the bowl 13 taken along lines 7—7 of FIG. 6.

Figure 8:
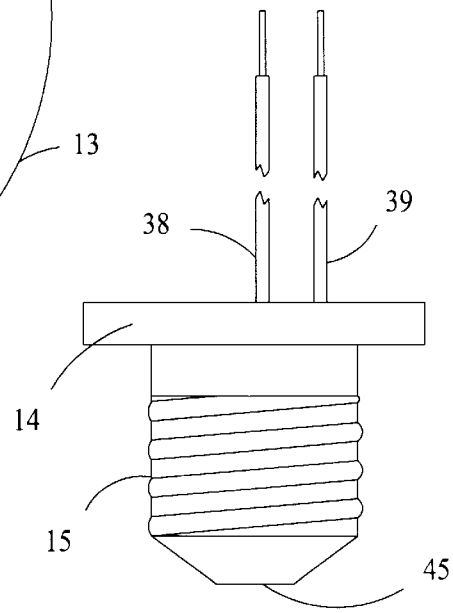
FIG. 8 is a side view of the flanged socket illustrating the first and second electrical leads (wires) emanating therefrom.

FIG. 8 is a side view of the flange socket 14 illustrating the first and second electrical leads 38 and 39 emanating therefrom. An electrical contact 45 recessed in the member and another electrical contact 15 in the form of circumferential threads bring power into the socket flange 14. This power is then distributed along electrical wires 38 and 39.

Referring again to FIG. 4, screw 40 secures the bowl 13 to the socket flange 14 and washers 43 and 44 along with nut 28 and stud 27 secure the interconnecting support 32 to the bowl 13.

It will be obvious to those skilled in the art that many modifications and changes can be made to the invention without departing from the spirit and scope of the attached claims. The invention has been set forth by way of example only and those skilled in the art will recognize it may be modified without departing from the spirit and scope of the appended claims.

I claim:

1. A lighting fixture comprising a socket flange; a bowl; said socket flange affixed to said bowl; an interconnecting support affixed to said bowl; a cover; said cover affixed to said interconnecting support; a first bracket for supporting a first bulb socket being affixed to said cover; a second bracket for supporting a second bulb socket being affixed to said cover; a third bracket for supporting a third bulb socket being affixed to said cover; a first electric light bulb mounted in said first bulb socket; a second electric light bulb mounted in said second bulb socket; a third electric light bulb mounted in said third bulb socket; and, wiring means supplying electric power to said lighting fixture.

2. A lighting fixture as claimed in claim 1 wherein said cover is affixed to said interconnecting support by means of an internally threaded cap.

3. A lighting fixture as claimed in claim 1 wherein said interconnecting support is U-shaped and includes a first interior threaded portion therein and a second interior threaded portion therein.

4. A lighting fixture as claimed in claim 3 further comprising a lower threaded stud engaging said first interior threaded portion and an upper threaded stud engaging said second interior threaded portion.

5. A lighting fixture as claimed in claim 4 further comprising a nut threaded to said lower threaded stud for affixing said interconnecting support to said bowl and a threaded cap threaded to said upper threaded stud for affixing said cover to said bowl.

* * * * *